US005954571A

United States Patent [19]

Case

[11] Patent Number: 5,954,571

[45] Date of Patent: Sep. 21, 1999

[54] ROUNDED CORNERBEAD SANDING TOOL

[76] Inventor: James W Case, 35 Utica St., Denver, Colo. 80219

[21] Appl. No.: 08/856,746

[22] Filed: May 15, 1997

[51] Int. Cl.[6] ..... B24B 23/00

[52] U.S. Cl. ..... 451/354; 451/495; 451/522; 451/524

[58] Field of Search ..... 15/244.1, 244.2; 451/344, 354, 495, 521, 522, 523, 524, 525

[56] References Cited

U.S. PATENT DOCUMENTS

| | | | |
|---|---|---|---|
| 849,991 | 4/1907 | Forrest . | |
| 1,801,118 | 4/1931 | Smith . | |
| 1,941,550 | 1/1934 | Garvey . | |
| 2,434,581 | 1/1948 | Ottoson . | |
| 3,123,947 | 3/1964 | Rawley | 451/524 X |
| 3,412,416 | 11/1968 | Simon . | |
| 4,077,083 | 3/1978 | Siemund et al. . | |
| 4,848,037 | 7/1989 | Happe | 451/524 X |
| 4,964,243 | 10/1990 | Reiter | 451/524 X |
| 5,036,627 | 8/1991 | Walters | 451/524 X |
| 5,193,313 | 3/1993 | Sanchez et al. | 451/524 X |
| 5,212,847 | 5/1993 | Melcher et al. . | |
| 5,613,897 | 3/1997 | Thompson, Jr. | 451/524 X |
| 5,678,278 | 10/1997 | McBride et al. . | |
| 5,690,547 | 11/1997 | Holland, Jr. et al. | 451/524 |

*Primary Examiner*—Timothy V. Eley
*Attorney, Agent, or Firm*—Edwin H. Crabtree; Ramon L. Pizarro; Nathan S. Cassell

[57] ABSTRACT

A rounded cornerbead sanding tool including a female pole adapter for attachment to common extension poles. Two (2) separated pivot joints allowing greater angle accessibility including inverted angles. Three (3) interchangeable sanding sponge forming arms to form sanding sponge to recessed or protruding "U" shape for sanding "Outside" or "Inside" cornerbeads, angles and flat surfaces. Slot formed through center of larger than now commonly available sanding sponge for attachment to tool head.

20 Claims, 2 Drawing Sheets

ROUNDED CORNERBEAD SANDING TOOL

BACKGROUND OF THE INVENTION (a) Field of the Invention

This invention relates to sanding tools and more particularly, but not by way of limitation, to a sanding tool that is rounded and can be used for sanding excess drywall compound or texture compound from rounded corner beads and a variety of other contoured or curved surfaces.

(b) Discussion of Prior Art

Heretofore there have been a variety of different types of sanding tools used by hand or mounted on poles and used during building construction. Many times it is desirable to be able to use a sanding tool for sanding off the excess drywall compound and texture compound which is used in the completion of the drywall phase of building construction. With the square corner bead of the past, a flat head sanding pole worked quite well. However, current housing construction trends have shifted from the square rooms and corners of the past to arched openings, vaulted ceilings and rounded corner bead of today. With today's rounded corner bead and offset angle beads, a flexible sander is needed.

A flexible sanding sponge is available on today's market, but it is slow and it requires climbing of ladders and scaffolding to areas above the reach of the an average human. There are several types of flat head sanders available on today's market. These sanding tools are described in U.S. Pat. No. 2,434,581 to Ottoson, U.S. Pat. No. 2,711,059 to Ames, U.S. Pat. No. 4,516,361 to Gringer, U.S. Pat. No. D369,080 to Tollis and U.S. Pat. No. 5,220,752 to Cheney et al. These patents disclose the use of a flat and rigid sanding surface and used primarily for sanding flat surfaces.

While the above patents illustrate sanders for sanding flat surfaces, none of these patents address the sanding of rounded corner beads and different contours of interior and exterior corners. Also, none of the above cited patents incorporate the unique combination of structure and function of the subject rounded corner bead sanding tool as described herein.

SUMMARY OF THE INVENTION

In view of the foregoing, it is a primary object of the subject invention to provide a lightweight, inexpensive sanding tool that is rugged in construction and can be used for sanding a variety of contoured surfaces.

Another object of the invention is to provide a new and improved sanding tool which overcomes the limitations and disadvantages of prior sanding tools such as briefly described above.

Still another object of the invention is to provide a sanding tool for sanding a variety of contoured surfaces such as interior and exterior corners of drywall construction, as well as flat surfaces. The sanding tool is also designed for use in sanding arched openings, vaulted ceilings and rounded corner beads in building construction.

Yet another object of the invention is the sanding tool is adapted for attachment to a extension pole, thus allowing a person to use the tool in heretofore out of reach places.

Still another object of the subject sanding tool and a key feature is through the use of different angled sponge contour forming arms, the tool can be easily converted from use in sanding interior corners to use in sanding exterior corners and flat surfaces.

The subject invention includes a lower pivot assembly, an upper pivot assembly, a pair of sponge contour forming arms and a sanding sponge. The lower pivot assembly acts as a fulcrum for pivoting the upper pivot assembly. In turn upper pivot assembly acts as a fulcrum for pivoting the sponge contour forming arms and sanding sponge. The lower pivot assembly includes a female coupler attached to a collar which is attached to a pair of parallel shank arms. the female coupler is adapted for releasable attachment to the extension pole or any other type of holding device which a person may choose to employ when using the sanding tool. The upper pivot assembly includes a connecting block attached to the shank arms and to one end of a pair of angled spacer arms. The other ends of the spacer arms are attached to one end of the sponge contour forming arms. The opposite end of the forming arms are designed for insertion into the sanding sponge for providing structural support for the sanding sponge and maintaining the sanding sponge in a desired configuration for sanding a particular contoured surface.

These and other objects of the present invention will become apparent to those familiar with sanding tools from the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
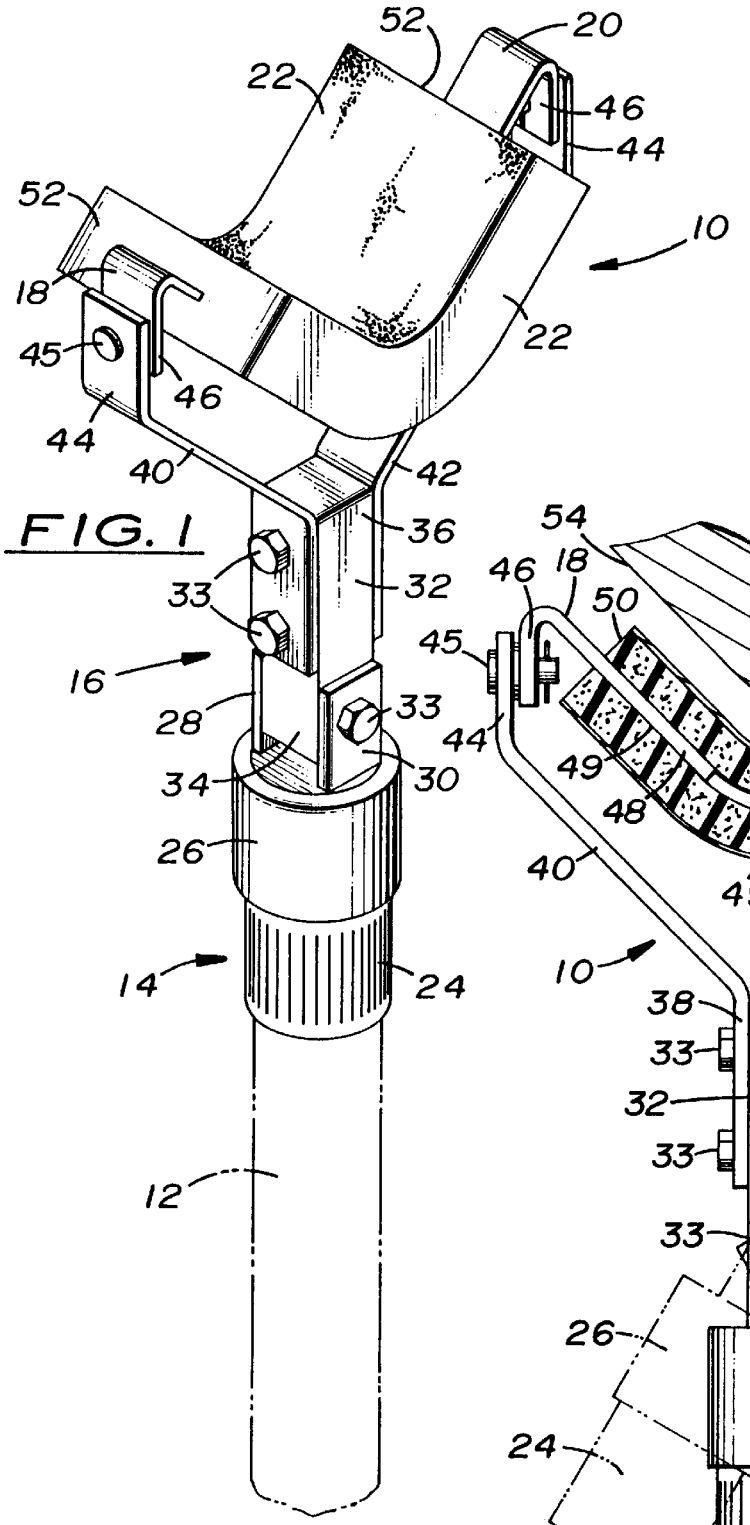
FIG. 1 is a perspective view the subject rounded corner bead sanding tool with the sponge contour forming arms bending the sanding sponge inwardly so that the sanding sponge is contoured for engaging and sanding an external corner of a wall.

In FIG. 1, a front view of the subject rounded corner bead sanding tool is shown having a reference numeral 10. The sanding tool 10 is adapted for attachment to an end of an extension pole 12. The sanding tool 10 broadly includes a lower pivot assembly 14, an upper pivot assembly 16, a first contour forming arm 18, a second contour forming arm 20 and a sanding sponge 22. The sanding sponge 22 is a size typically in a range having a width of 3 to 5 inches, a length of 4 to 6 inches and a thickness of ½ to 1½ inches.

The lower pivot assembly 14 acts as a fulcrum for pivoting the upper pivot assembly 16 thereon. In turn, upper pivot assembly 16 acts as a fulcrum for pivoting the sponge contour forming arms 18 and 20 and sanding sponge 22 thereon. The lower pivot assembly 14 includes a female coupler 24 attached to a collar 26. The collar is attached to a pair of parallel shank arms 28 and 30. The female coupler 24 is adapted for releasable attachment to the extension pole 12 or any other type of holding device which a person may choose to employ when using the sanding tool 10.

The upper pivot assembly 16 includes a connecting block 32 having a lower end 34 disposed between and attached to the parallel shank arms 28 and 30 using a threaded bolt 33 with a wing nut. The wing nut is not shown in the drawings. An upper end 36 of the connecting block 32, using a pair of bolts 33 and wing nuts 35, is attached to a lower end 38 of a first spacer arm 40 and a second spacer arm 42. An upper end 44 of the spacer arms 40 and 42 is rotatably attached, using clevis pins 45, to a first end 46 of the first contour forming arm 18 and a second contour forming arm 20.

The contour forming arms 18 and 20 are a key to the subject invention in that they act as an internal support for the sanding sponge 22 and by the nature of the bent angles of the forming arms 18 and 20, the sanding sponge 22 is contoured for engaging different angled surfaces to be sanded. In this drawing, a second end 48 of the forming arms 18 and 20 are shown insertion into a slot 49 in opposite sides 50 and 52. The opposite sides 50 and 52 run along the length of the sanding sponge 22 as shown. The slot 49 is ⅛ inch thick and ¾ inch wide and is used to help in bending the sanding sponge 22 to match the contour of a corner of a wall or wall surface to be sanded. The slot 49 is centered along the sides of the length on the sponge and runs internally along the width of the sponge 49. The second end 48 of the forming arms 50 and 52 is seen in FIG. 2 received inside the slot 49 with the sanding sponge 22 shown in cross section.

Figure 2:
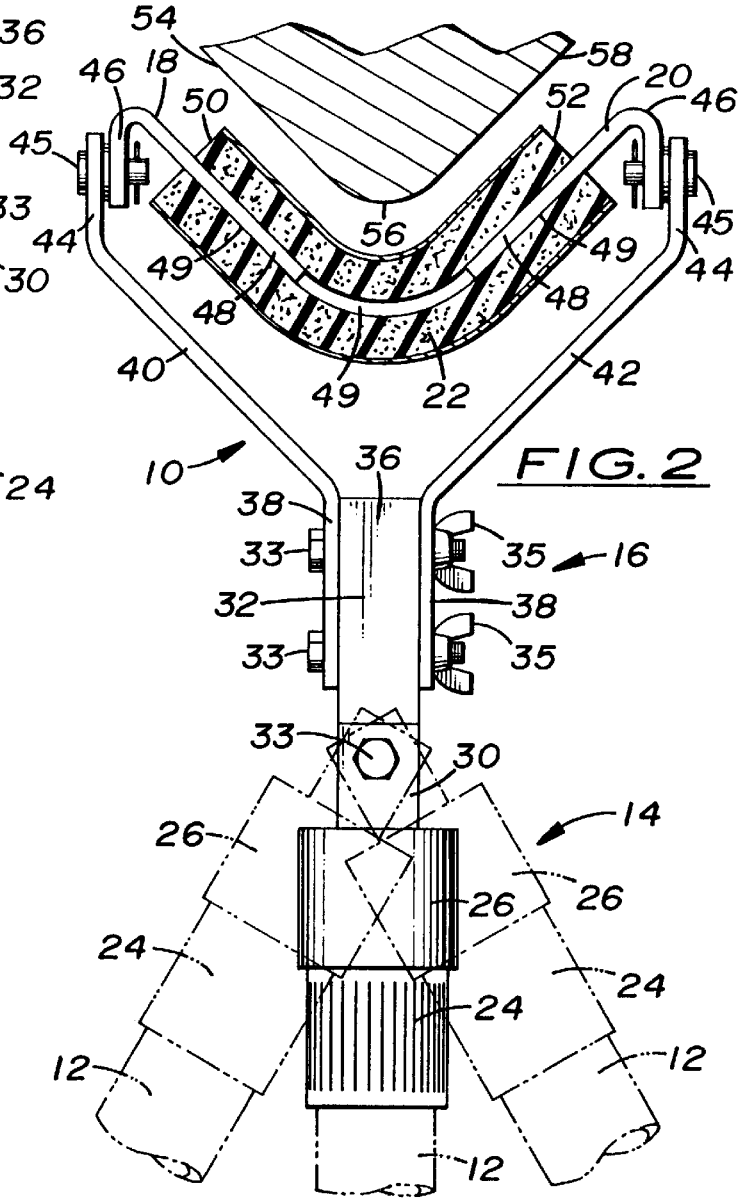
FIG. 2 is a front view of the rounded corner bead sanding tool with the sanding sponge shown in cross section. In this drawing, the sponge contour forming arms are shown received in opposite sides of the sanding sponge. Also, the lower pivot assembly is shown pivoted to the right and to the left for adjusting the sanding tool to different angles when engaging a surface to be sanded. A portion of an external corner of a wall is shown in this drawing.

In FIG. 2, a front view of the rounded corner bead sanding tool 10 is shown with the sanding sponge 22 in cross section. In this drawing, the second ends 48 of the sponge contour forming arms 18 and 20 are shown received in opposite sides 50 and 52 of the sanding sponge 22. The forming arms 18 and 20 have bent or curved the sanding sponge 22 into a "V" shape for engaging a portion of a side 54, a rounded exterior corner bead 56 and an opposite side 58 of an exterior corner 60. By curving or bending the sanding sponge 22 as shown, it can be seen that the unique sanding tool 10 is readily adaptable for sanding the complete surface of the exterior corner 60.

Also, in this drawing, the lower pivot assembly 14 is shown pivoted to the right and to the left for adjusting the sanding tool 10 to different angles when engaging a surface to be sanded, such as the exterior corner 60. Only a portion of the exterior corner 60 of a wall is shown in this drawing. The lower pivot assembly 14 is adjustably mounted and tightened on the lower end 34 of the connecting block 32 using a bolt 33 and wing nut 35 secured to the parallel shank arms 28 and 30.

Figure 3:
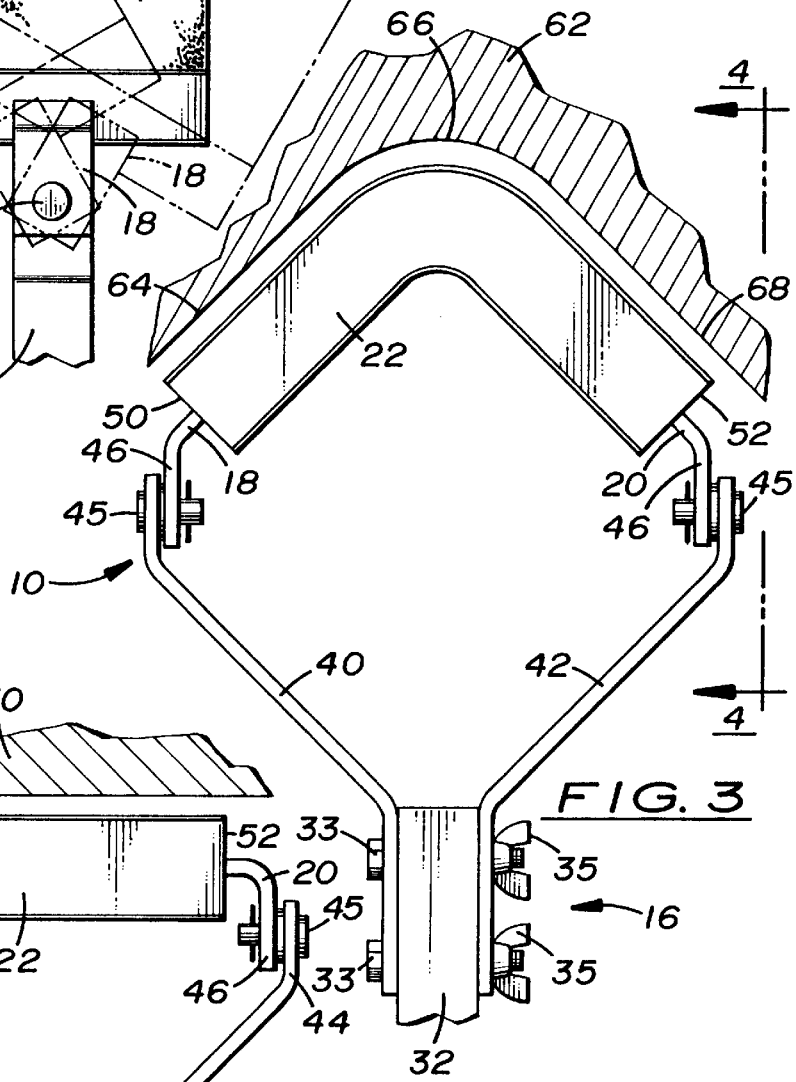
FIG. 3 is another front view of the rounded corner bead sanding tool. In this drawing, the sponge contour forming arms are shown received in opposite sides of the sanding sponge and bending the sanding sponge outwardly for engaging and sanding an internal corner of a wall or the like. A portion of an internal corner of a wall is shown in this drawing.

In FIG. 3, another front view of the rounded corner bead sanding tool 10 is illustrated. In this drawing, the sponge contour forming arms 18 and 20 are shown received in the opposite sides 50 and 52 of the sanding sponge 22. In this example, the forming arms 18 and 20 are bent so that the arms bend or curve the sanding sponge 22 outwardly into an inverted "V" shape for engaging and sanding an internal corner 62 of a wall or the like. The interior corner 62 having a side 64, a rounded interior corner bead 66 and an opposite side 68. Only a portion of an internal corner 62 of a wall is shown in this drawing.

Figure 4:
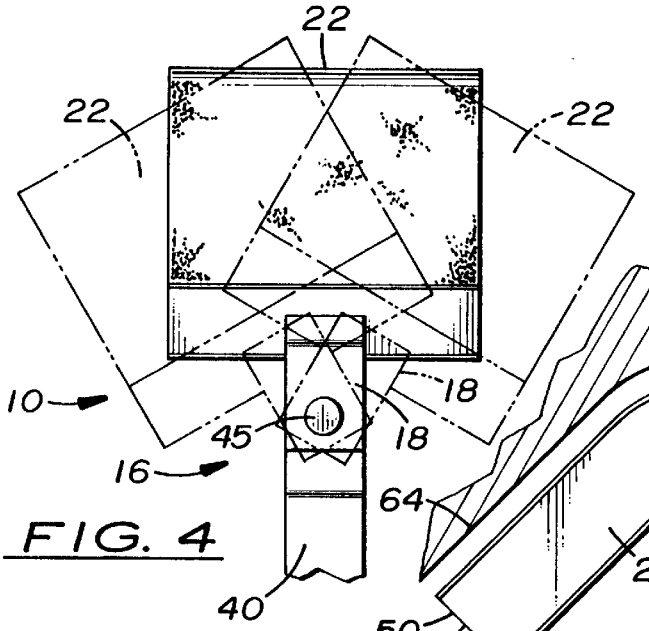
FIG. 4 is a side view of the sanding tool taken along lines 4—4 shown in FIG. 3. Also, the sanding sponge is shown pivoted on the sponge contour forming arms to the right and to the left for adjusting the sanding tool to different angles when engaging a surface to be sanded.

In FIG. 4, a side view of the sanding tool 10 is shown taken along lines 4—4 shown in FIG. 3. The sanding sponge 22 is shown with the sponge contour forming arms 18 and 20 pivoted to the right and to the left on the pivot pins 45 connected to the spacer arms 40 and 42.

Figure 5:
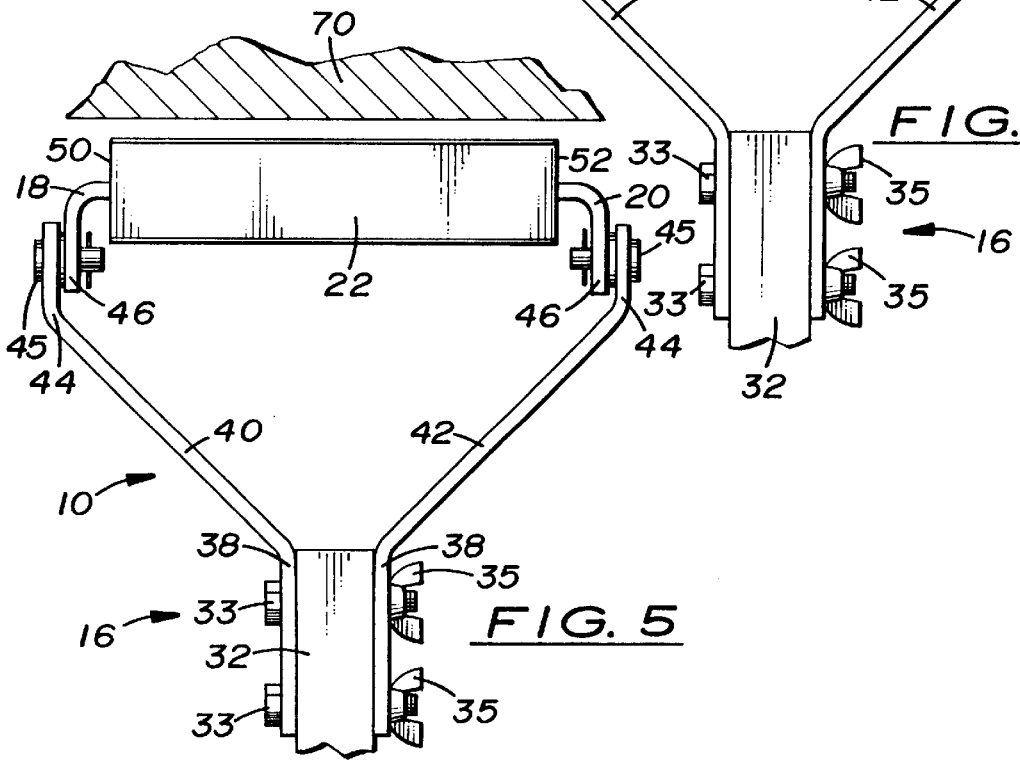
FIG. 5 is another front view of the rounded corner bead sanding tool. In this drawing, the sponge contour forming arms are shown received in opposite sides of the sanding sponge for holding the sanding sponge in a straight line for sanding a flat wall or flat ceiling surface.

In FIG. 5, another front view of the rounded corner bead sanding tool 10 is shown. In this drawing, the sponge contour forming arms 18 and 20 are shown received in opposite sides 50 and 52 of the sanding sponge 22. In this example, the forming arms 18 and 20 are bent for holding the sanding sponge 22 in a straight line for sanding a portion of a flat wall 70, a flat ceiling surface or other similar surfaces.

From the above description of the subject sanding tool 10, it is obvious that a variety of different shapes of forming arms 18 and 20 may be constructed, each exhibiting different degrees of angles, thus allowing for the sanding sponge 22 to sand a wide variety of contoured and shaped surfaces.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A rounded corner bead sanding tool for sanding interior and exterior corners of drywall construction, as well as flat surfaces, the sanding tool adapted for releasably attachment to an extension pole, the sanding tool comprising:

a lower pivot assembly having an upper portion and a lower portion, the lower portion of said lower pivot assembly adapted for releasably attachment to the extension pole;

an upper pivot assembly having an upper portion and a lower portion, the lower portion of said upper pivot assembly mounted on the upper portion of said lower pivot assembly;

a pair of sponge contour forming arms, said forming arms having a first end and a second end, the first end of each of said forming arms pivotly mounted on the upper portion of each of said upper pivot assembly; and a sanding sponge, the second end of said forming arms received in opposite sides of said sanding sponge, each of said forming arms forming a desired contour on said sanding sponge.

2. The sanding tool as described in claim 1 wherein the upper portion of said upper pivot assembly includes a pair of spacer arms extending outwardly therefrom, an upper end of each of said spacer arms attached to the first end of each of said forming arms.

3. The sanding tool as described in claim 1 wherein the lower portion of said lower pivot assembly includes a female coupler, said female coupler adapted for releasable attachment to the extension pole.

4. The sanding tool as described in claim 1 wherein the upper portion of said lower pivot assembly includes a collar attached to a pair of parallel shank arms, said shank arms pivotly attached to the lower portion of said upper assembly.

5. The sanding tool as described in claim 4 wherein the lower portion of said upper pivot assembly includes a connecting block attached to said shank arms.

6. The sanding tool as described in claim 1 wherein the second end of each of said forming arms extend downwardly for forming said sanding sponge into a "V" shaped configuration for sanding exterior corners.

7. The sanding tool as described in claim 1 wherein the second end of each of said forming arms extend upwardly for forming said sanding sponge into an inverted "V" shaped configuration for sanding interior corners.

8. The sanding tool as described in claim 1 wherein the second end of each of said forming arms extend outwardly toward each other for maintaining said sanding sponge in a flat planer configuration for sanding flat surfaces.

9. The sanding tool as described in claim 1 wherein said sanding sponge includes a slot therein extending across a width of each of said sanding sponge for receiving the second ends of said forming arms therein.

10. A rounded corner bead sanding tool for sanding interior and exterior corners of drywall construction, as well as flat surfaces, the sanding tool adapted for releasably attachment to an extension pole, the sanding tool comprising:

a lower pivot assembly having an upper portion and a lower portion, the lower portion of said lower pivot assembly adapted for releasably attachment to the extension pole;

an upper pivot assembly having an upper portion and a lower portion;

pivot means attached to the lower portion of said upper pivot assembly and the upper portion of said lower pivot assembly, said pivot means for allowing said upper pivot assembly to pivot on top of said lower pivot assembly;

a pair of sponge contour forming arms, said forming arms having a first end and a second end, the first end of each of said forming arms pivotly mounted on the upper portion of said upper pivot assembly; and a sanding sponge, the second end of each of said forming arms received in opposite sides of said sanding sponge, said forming arms forming a desired contour on said sanding sponge.

11. The sanding tool as described in claim 10 wherein the upper portion of said upper pivot assembly includes a pair of spacer arms extending outwardly therefrom, an upper end of each of said spacer arms attached to the first end of said forming arms.

12. The sanding tool as described in claim 11 wherein each of said spacer arms are pivotly attached using clevis pins to the first end of said forming arms.

13. The sanding tool as described in claim 10 wherein the lower portion of said lower pivot assembly includes a female coupler, said female coupler adapted for releasably attachment to the extension pole.

14. The sanding tool as described in claim 10 wherein the upper portion of said lower pivot assembly includes a collar attached to a pair of parallel shank arms, said shank arms attached to said pivot means.

15. The sanding tool as described in claim 14 wherein said pivot means is a threaded bolt with wing nut.

16. The sanding tool as described in claim 10 wherein the second end of said forming arms extend downwardly for forming each of said sanding sponge into a "V" shaped configuration for sanding exterior corners.

17. The sanding tool as described in claim 10 wherein the second end of each of said forming arms extend upwardly for forming said sanding sponge into an inverted "V" shaped configuration for sanding interior corners.

18. The sanding tool as described in claim 10 wherein the second end of each of said forming arms extend outwardly toward each other for maintaining said sanding sponge in a flat planer configuration for sanding flat surfaces.

19. The sanding tool as described in claim 10 wherein said sanding sponge includes a slot therein and extending across a width of said sanding sponge for receiving the second end of each of said forming arms therein.

20. A rounded corner bead sanding tool for sanding interior and exterior corners of drywall construction, as well as flat surfaces, the sanding tool adapted for releasably attachment to an extension pole, the sanding tool comprising:

a lower pivot assembly having an upper portion and a lower portion, the lower portion of said lower pivot including a female coupler, said female coupler adapted for releasably attachment to the extension pole;

an upper pivot assembly having an upper portion and a lower portion, the upper portion of said upper pivot assembly including a pair of spacer arms extending outwardly therefrom, the lower portion of said upper pivot assembly pivotly attached to the upper portion of said lower pivot assembly;

a pair of sponge contour forming arms, said forming arms having a first end and a second end, the first end of each of said forming arms pivotly mounted on said spacer arms; and a sanding sponge, the second end of each of said forming arms received in a slot in opposite sides of said sanding sponge, said forming arms forming a desired contour on said sanding sponge.

* * * * *